US007559203B2

(12) United States Patent
Stastny et al.

(10) Patent No.: US 7,559,203 B2
(45) Date of Patent: Jul. 14, 2009

(54) COOLED SUPPORT BOSS FOR A COMBUSTOR IN A GAS TURBINE ENGINE

(75) Inventors: Honza Stastny, Georgetown (CA); Jeffrey Richard Verhiel, Toronto (CA)

(73) Assignee: Pratt & Whitney Canada Corp., Longueuil, Québec (CA)

( * ) Notice: Subject to any disclaimer, the term of this patent is extended or adjusted under 35 U.S.C. 154(b) by 569 days.

(21) Appl. No.: 11/227,285

(22) Filed: Sep. 16, 2005

(65) Prior Publication Data

US 2007/0062202 A1 Mar. 22, 2007

(51) Int. Cl.
*F02C 7/20* (2006.01)

(52) U.S. Cl. ..... 60/796

(58) Field of Classification Search ..... 60/796, 60/772, 800

See application file for complete search history.

(56) References Cited

U.S. PATENT DOCUMENTS

| | | | | |
|---|---|---|---|---|
| 2,410,450 | A | 11/1946 | Kroon | |
| 3,199,294 | A | 8/1965 | Hagen | |
| 3,797,236 | A | 3/1974 | Hooke et al. | |
| 3,911,672 | A | 10/1975 | Irwin | |
| 4,422,300 | A | 12/1983 | Dierberger et al. | |
| 4,907,411 | A | 3/1990 | Krüeger | |
| 5,085,038 | A | 2/1992 | Todman et al. | |
| 5,353,586 | A | 10/1994 | Taylor et al. | |
| 5,363,643 | A * | 11/1994 | Halila | 60/796 |
| 5,367,869 | A * | 11/1994 | DeFreitas | 60/776 |
| 6,463,742 | B2 * | 10/2002 | Mandai et al. | 60/806 |
| 6,668,559 | B2 | 12/2003 | Calvez et al. | |
| 2004/0093872 | A1 | 5/2004 | Tiemann | |
| 2004/0261419 | A1 | 12/2004 | McCaffrey et al. | |

* cited by examiner

*Primary Examiner*—Michael Cuff
*Assistant Examiner*—Andrew Nguyen
(74) *Attorney, Agent, or Firm*—Ogilvy Renault LLP

(57) ABSTRACT

The support boss is used in a combustor of a gas turbine engine. It comprises a side wall defining an internal space. The side wall has at least one air inlet orifice. It also comprises a bottom wall closing one end of the internal space. The bottom wall has at least one air outlet orifice.

5 Claims, 3 Drawing Sheets

COOLED SUPPORT BOSS FOR A COMBUSTOR IN A GAS TURBINE ENGINE

TECHNICAL FIELD

The field of invention relates generally to the design of combustors used in gas turbine engines and, more particularly, to an improved support boss for a combustor.

BACKGROUND OF THE ART

Like other components of a gas turbine engine, a combustor must be held in place using an appropriate supporting arrangement. Such arrangement may include arms extending between the combustor and the walls of the chamber in which the combustor is located. Most of the combustor is spaced apart from the walls of the chamber, thereby allowing air flowing around the combustor. One end of each arm is attached to the combustor using an attachment point referred to as a "support boss".

As its name indicates, the combustor is the location where fuel is mixed with compressed air and burned. The hot combustion gases are then sent to the downstream turbine area of the gas turbine engine. The highly intense heat generated by the combustor generally requires the presence of a network of cooling orifices through the walls of the combustor. Air surrounding the combustor is then forced into these orifices, thereby maintaining a lower temperature at the walls of the combustor. However, conventional support bosses tend to create local hot spots because they do not allow the presence of cooling orifices. This generates stresses due to temperature gradients. Hot spots may also be created on a heat shield located underneath a conventional support boss. Heat shields are located inside the combustor and are spaced apart from the interior of the wall of the combustor. When no cooling air is provided, the heat shield is subjected to a higher temperature.

Accordingly, there is a need to provide an improved support boss which can mitigate the presence of hot spots on them or around surrounding parts.

SUMMARY OF THE INVENTION

In one aspect, the present invention provides a support boss for use in a combustor of a gas turbine engine, the support boss comprising a side wall defining an internal space, the side wall having at least one air inlet orifice; and a bottom wall closing one end of the internal space, the bottom wall having at least one air outlet orifice.

In another aspect, the present invention provides a support boss for a combustor of a gas turbine engine, the support boss comprising a side wall having opposite first and second ends, the side wall defining an internal space and being configured and disposed for receiving an end of a support arm on the first end thereof, the first end of the support boss being closed when the support arm is attached on the side wall; a bottom wall provided at the second end of the side wall; means for providing air inside the internal space; and means for retrieving air from inside the internal space.

In another aspect, the present invention provides a method of cooling a support boss attached to a combustor in a gas turbine engine, the method comprising providing air inside the support boss; and retrieving at least some of the air from inside the support boss and sending it inside the combustor.

Further details of these and other aspects of the present invention will be apparent from the detailed description and accompanying figures.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
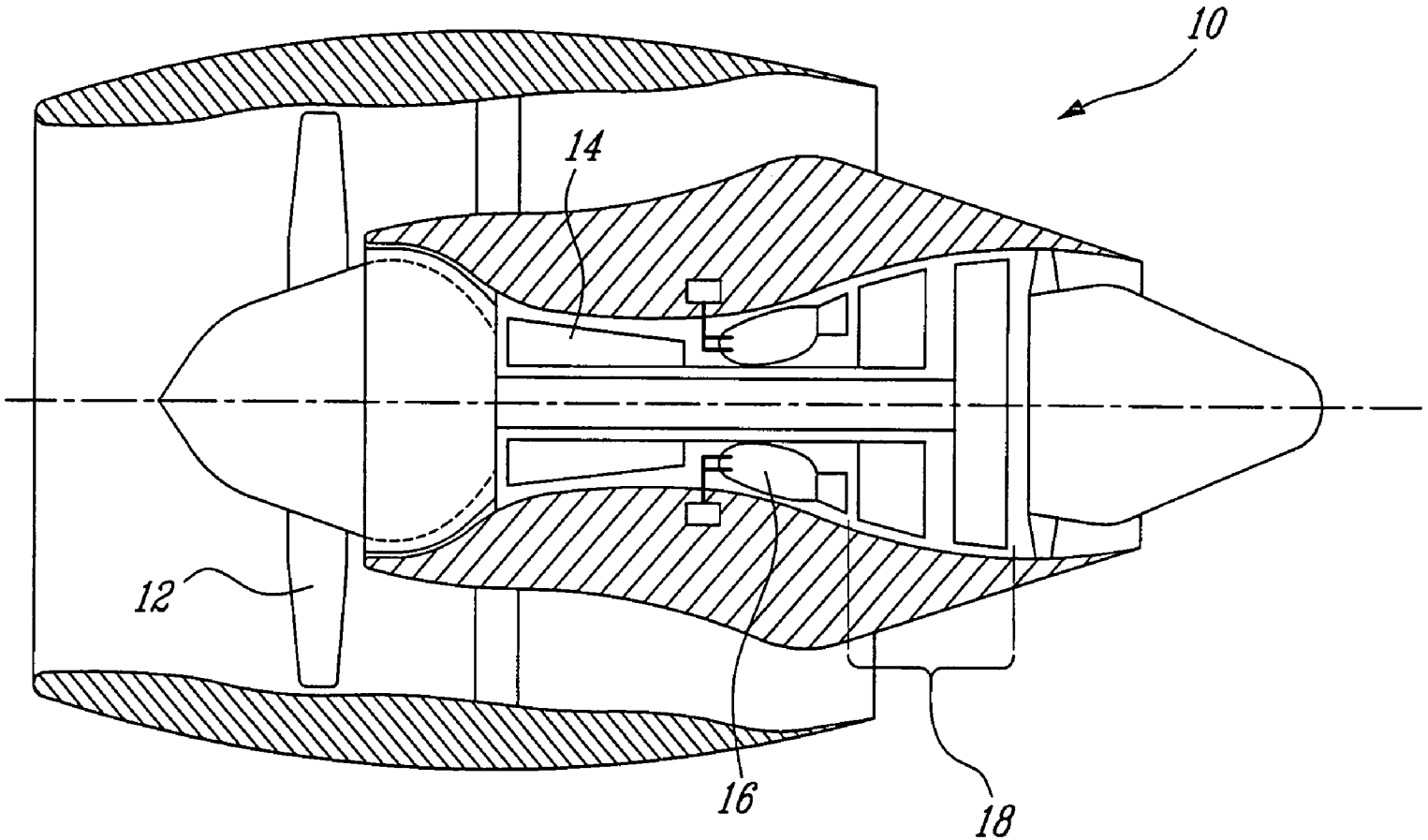
FIG. 1 is a schematic view of a gas turbine engine showing an example of a possible environment in which cooled support bosses can be used.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
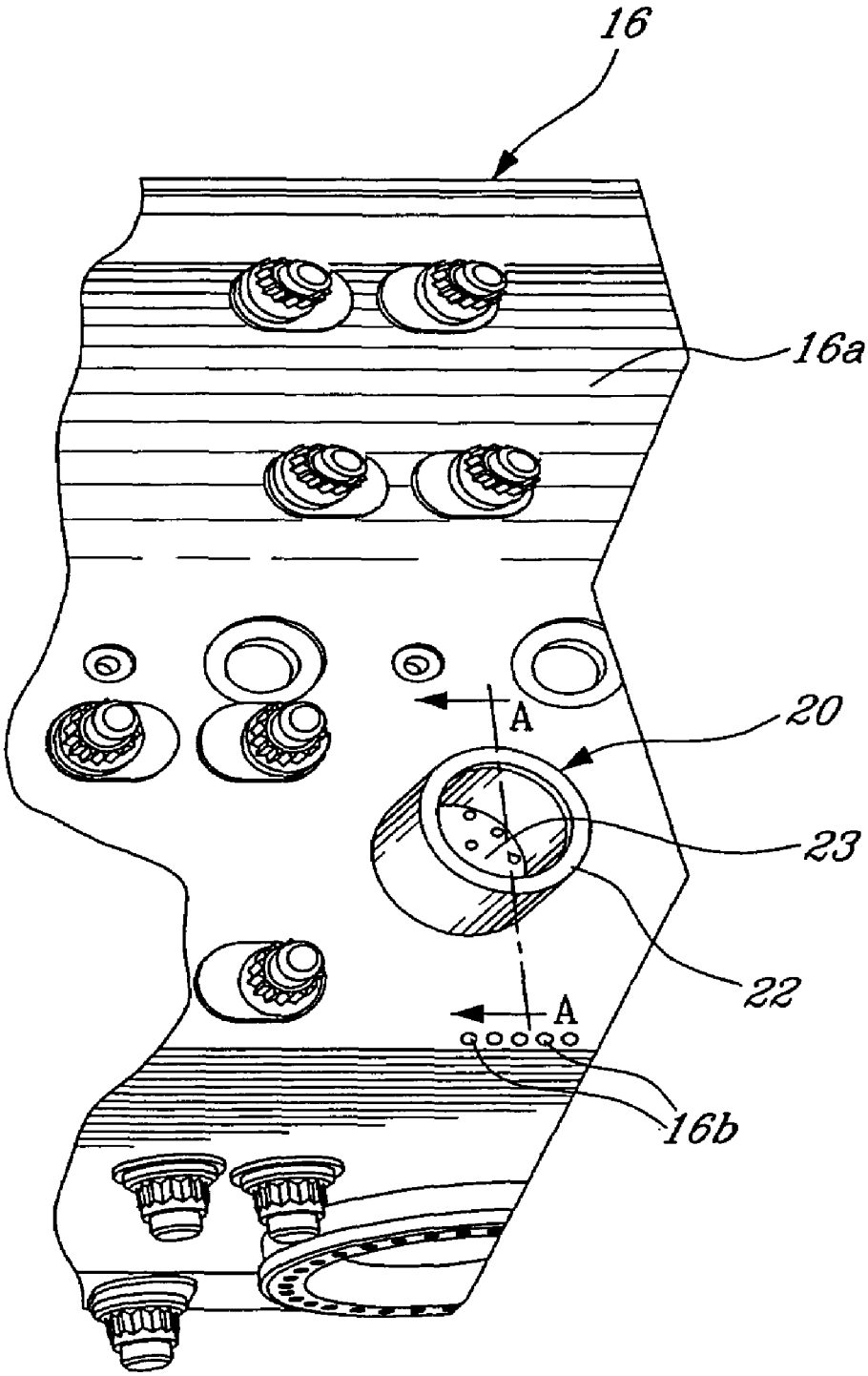
FIG. 2 is a partial perspective view of a combustor provided with a cooled support boss in accordance with a preferred embodiment of the present invention.

FIG. 2 shows an example of a combustor 16 in accordance with a possible embodiment of the present invention. Although only one support boss 20 is illustrated herein, a combustor generally comprises a plurality of these support bosses 20 that are located around the periphery thereof. Each of these support bosses 20 acts as an attachment point for an end of a corresponding arm 21 (FIGS. 3 and 4) that is used to hold the combustor 16 in place. One of the ends of the support boss 20 is then partially sealed when the end of the arm 21 is attached thereto.

Each support boss 20 is attached to the periphery of a hole made through the wall 16*a* of the combustor 16, for instance using welding, brazing or the like. The wall 16*a* of the combustor 16 comprises cooling orifices 16*b*. It should be noted that most cooling orifices are omitted from FIG. 2 to simplify the drawing.

Figure 3:
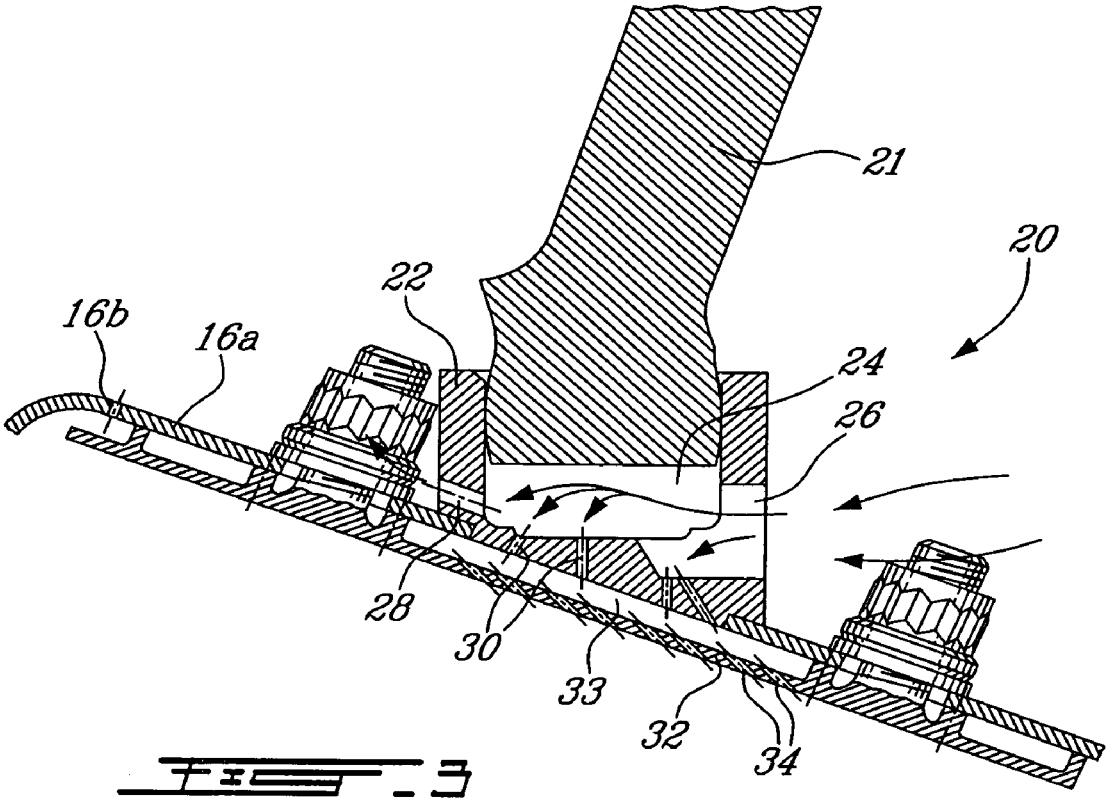
FIG. 3 is a cross-section view of the support boss in accordance with line A-A in FIG. 2, showing a wall section with a heat shield.
Figure 4:
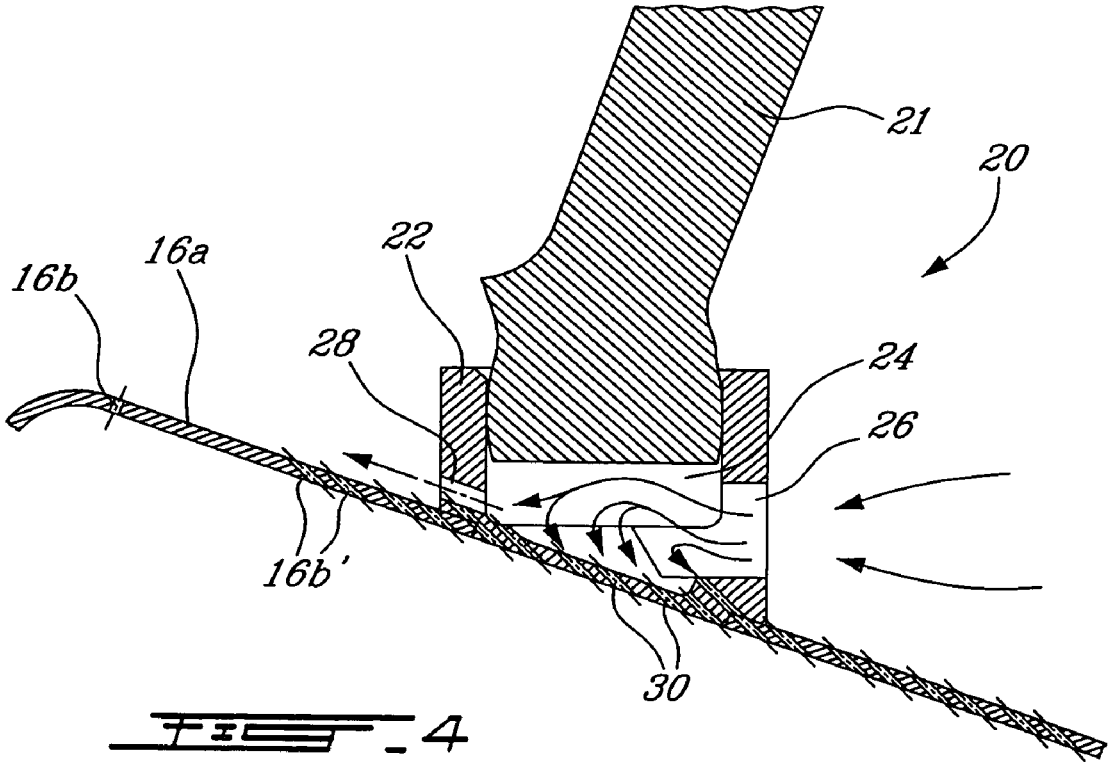
FIG. 4 is a view similar to FIG. 3, showing a wall section without a heat shield.

As best shown in FIGS. 2, 3 and 4, the support boss 20 comprises a side wall 22 and a bottom wall 23. The side wall 22 and the bottom wall 23 define a space that is closed when the corresponding arm 21 is attached thereto, thereby leaving an internal space 24 within the side wall 22 of the support boss 20.

The side wall 22 is provided with at least one air inlet orifice 26 extending between outside the side wall 22 and the internal space 24. The inlet orifice 26 is preferably oriented so as to face the main flow of air. The illustrated support boss 20 also comprises at least one air outlet orifice 28 made through an opposite side of the side wall 22. This outlet orifice 28 is provided to reduce the wake downstream the support boss 20 and to equalize the pressure around the support boss 20 so as to maintain the efficiency of the cooling orifices 16*b*, 16*b*' made through the wall 16*a* behind the support boss 20.

The bottom wall 23 comprises a plurality of air outlet orifices 30 extending between the internal space 24 and the interior of the combustor 16. Some of these orifices 30 may be located in the air inlet orifice 26. In use, air enters the support boss 20 through the inlet orifice 26 and some of it escapes through the smaller outlet orifice 28, if provided. Air also escapes through the orifices 30. This way, a cooling path is created to lower the temperature of the support boss 20 and the surrounding parts.

FIG. 3 shows the combustor 16 being provided with an internal heat shield 32 positioned underneath the support boss 20. The heat shield 32 is maintained in a spaced-apart relationship with the interior side of the wall 16*a*, thereby leaving only a small space 33 between them. At least some of the cooling air flowing through the orifices 30 impinges on the heat shield 32, thereby reducing its temperature. Also, the heat shield 32 comprises a plurality of orifices 34 so that air can flow through it to increase cooling.

FIG. 4 shows a portion of a combustor 16 similar to that shown in FIG. 3 but without a heat shield. The support boss 20 comprises a side wall 22, a bottom wall 23, an internal space 24, at least one inlet orifice 26, at least one outlet orifice 28 and a plurality of orifices 30 made through the bottom wall 23. This figure shows the orifices 30, sometimes referred to as effusion holes, having a compound angle with the flow of air to maximize the cooling efficiency. It also shows the wall 16*a* having orifices 16*b*' similar to the orifices 30. This promotes the adherence of a film of air against the interior of the wall 16*a* of the combustor 16. The film of air is created when the air of adjacent orifices 16*b*', 30 join. This is also used in the heat shield 32 illustrated in FIG. 3.

The above description is meant to be exemplary only, and one skilled in the art will recognize that changes may be made to the embodiments described without departing from the scope of the invention disclosed. For example, the shape of the combustor 16 and the support boss 20 thereof can be different than what is shown in FIGS. 2 to 4. Although the support boss 20 is shown as being circular, other shapes are possible. The use of a heat shield is optional and depends on the design of the combustor 16. Still other modifications which fall within the scope of the present invention will be apparent to those skilled in the art, in light of a review of this disclosure, and such modifications are intended to fall within the appended claims.

What is claimed is:

1. A combustor of a gas turbine engine, the combuster comprising:

An outer wall; and at least one support boss, each support boss including: a side wall defining an internal space for receiving an end of a support arm and connected to the outer wall, the side wall having at least one air inlet side orifice and at least one air outlet side orifice that is substantially opposite the at least one air inlet side orifice, the at least one air outlet side orifice being outside the combustor; and a bottom wall closing an end of the internal space that is adjacent to the outer wall, the bottom wall having at least one air outlet bottom orifice.

2. The combustor as defined in claim 1, wherein the side wall of each support boss has a substantially circular cross section.

3. The combustor as defined in claim 1, wherein the support boss further comprises at least one air outlet bottom orifice made through the bottom wall.

4. The combustor as defined on claim 1, wherein the support boss further comprises means for attaching the support boss over the outer hole made through a wall of the combustor.

5. The combustor as defined in claim 1, wherein the at least one air inlet side orifice has an air inlet surface area that is larger than an air outlet surface area of the at least one air outlet side orifice.

* * * * *